US006732641B2

(12) United States Patent
Fissell

(10) Patent No.: US 6,732,641 B2
(45) Date of Patent: May 11, 2004

(54) METHOD FOR PROVIDING DISPLAY IMAGES IN AN ILLUMINATED DISPLAY DEVICE

(75) Inventor: Jeremy Justin Fissell, San Luis Obispo, CA (US)

(73) Assignee: Industrial Sol Art & Design, Ltd., Cleveland, OH (US)

( * ) Notice: Subject to any disclaimer, the term of this patent is extended or adjusted under 35 U.S.C. 154(b) by 0 days.

(21) Appl. No.: 10/026,664

(22) Filed: Dec. 19, 2001

(65) Prior Publication Data

US 2002/0096064 A1 Jul. 25, 2002

Related U.S. Application Data

(60) Provisional application No. 60/257,358, filed on Dec. 22, 2000.

(51) Int. Cl.[7] ..... B41L 13/12

(52) U.S. Cl. ..... 101/128.4; 101/129; 427/282

(58) Field of Search ..... 101/127, 128.21, 101/128.4, 129, 401.1; 428/13, 38, 912.2; 427/265, 266, 269, 272, 282, 287; 40/542, 544, 546, 547; 362/31, 812

(56) References Cited

U.S. PATENT DOCUMENTS

| | | | | |
|---|---|---|---|---|
| 2,731,333 A | | 1/1956 | Ko et al. | |
| 2,948,074 A | | 8/1960 | Dupree | |
| 3,241,256 A | | 3/1966 | Viret et al. | |
| 3,643,597 A | * | 2/1972 | Lala | 430/308 |
| 3,931,425 A | | 1/1976 | Kuroda | |
| 4,715,137 A | | 12/1987 | Scheve | |
| 4,791,010 A | | 12/1988 | Hanley et al. | |
| 4,860,171 A | | 8/1989 | Kojima | |
| 4,985,809 A | | 1/1991 | Matsui et al. | |
| 5,283,968 A | | 2/1994 | Williams | |
| 5,390,436 A | | 2/1995 | Ashall | |
| 5,407,711 A | | 4/1995 | Lovison et al. | |
| 5,625,968 A | | 5/1997 | Ashall | |

* cited by examiner

*Primary Examiner*—Leslie J. Evanisko
(74) *Attorney, Agent, or Firm*—Calfee, Halter & Griswold LLP

(57) ABSTRACT

A method and system for providing an image for display by an illuminated display device is provided whereby certain areas of the image appear highlighted to a viewer. An illuminated display device for displaying an image on a medium or on a transparency is also provided. The images are modified so that, as displayed, white and/or partially white areas appear as highlighted to a viewer.

14 Claims, 10 Drawing Sheets

METHOD FOR PROVIDING DISPLAY IMAGES IN AN ILLUMINATED DISPLAY DEVICE

CROSS-REFERENCE TO RELATED APPLICATIONS

This application claims the benefit of U.S. Provisional Application No. 60/257,358 filed Dec. 22, 2000.

FIELD OF THE INVENTION

The invention relates generally to an illuminated display device and a method for providing materials for displaying images thereon.

BACKGROUND OF THE INVENTION

It is well-known to provide an illuminated display device of the type where an image is etched into a clear (light transmitting) medium such as glass or acrylic and the medium is held by a base which contains a light source. In these well-known displays, an edge of the clear medium rests on or near the light source, and light emitted from the light source propagates up and through the clear medium. A percentage of this light travels completely through the medium and escapes out of certain surfaces of the medium, for instance, the top of the medium. This light is barely visible to a viewer looking at the image face of the medium. Another percentage of the light, however, contacts the etchings engraved in the medium and is refracted and/or diffused so that some of such light appears brightly to a viewer. The effect of such diffused and/or refracted light is to highlight the etchings of the etched image with beautiful results. Such etchings, however, are relatively expensive and time-consuming to produce, particularly when representing complicated and detailed images.

The present invention provides a display device and method for providing display images therefor which is relatively inexpensive and which highlights areas of an original image similarly to an etching, thus curing the above problems and others.

SUMMARY OF THE INVENTION

According to one embodiment of the present invention, a method for providing an image for display by an illuminated display device is provided. The method includes the steps of converting the image into a halftone, inverting the halftone, producing a film positive, producing a silk screen and silk screening the silk screen onto a medium.

According to another embodiment of the present invention, a method for providing an image for display by an illuminated display device is provided. The method includes the steps of converting the image into a halftone by use of a graphics program, inverting the halftone by use of a graphics program, adjusting at least one graphical property of the halftone by use of a graphics program, producing a film positive, producing a silk screen and silk screening the silk screen onto a medium.

According to another embodiment of the present invention, a display device for displaying a representation of a black and white image is provided. The display device includes a base, an illumination source and an image-bearing medium.

According to yet another embodiment of the present invention, a method for providing a color image for display by an illuminated display device is provided. The method includes the steps of converting the image into a CMYK file, converting the K channel of the CMYK file into a halftone, inverting the halftone, producing film positives of the image channels, producing silk screens and silk screening the silk screens onto a medium.

According to still another embodiment of the present invention, a method for providing a color image for display by an illuminated display device is provided. The method includes the steps of converting the image into a multi-channel file, creating an all-white image, producing film positives of the image channels and the all-white image, producing silk screens and silk screening the silk screens onto a medium.

According to still another embodiment of the present invention, a method for providing highlighted display of an image on a transparency by an illuminated display device is provided.

According to yet another embodiment of the present invention, a method for providing highlighted display of an image is provided. The method includes the steps of providing a template for formatting the image, creating a transparency of the formatted image, providing a background-bearing medium with an all-white image affixed thereto, and placing the transparency in front of the medium.

According to still another embodiment of the present invention, a system for providing highlighted display of an image is provided.

According to yet another embodiment of the present invention, an illuminated display device for displaying an image is provided. The device includes a background-bearing medium, a transparency, an illumination source and a medium retention means.

An advantage of the present invention is that a reproduction of an original image may be displayed upon an illuminated display device rather inexpensively while providing highlights of white or partially white areas of the image. Still further advantages of the present invention will become apparent to those of ordinary skill in the art upon reading and understanding the following detailed description of the preferred embodiments.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to illustrate the principles of this invention.

DETAILED DESCRIPTION OF ILLUSTRATED EMBODIMENT

Figure 1:
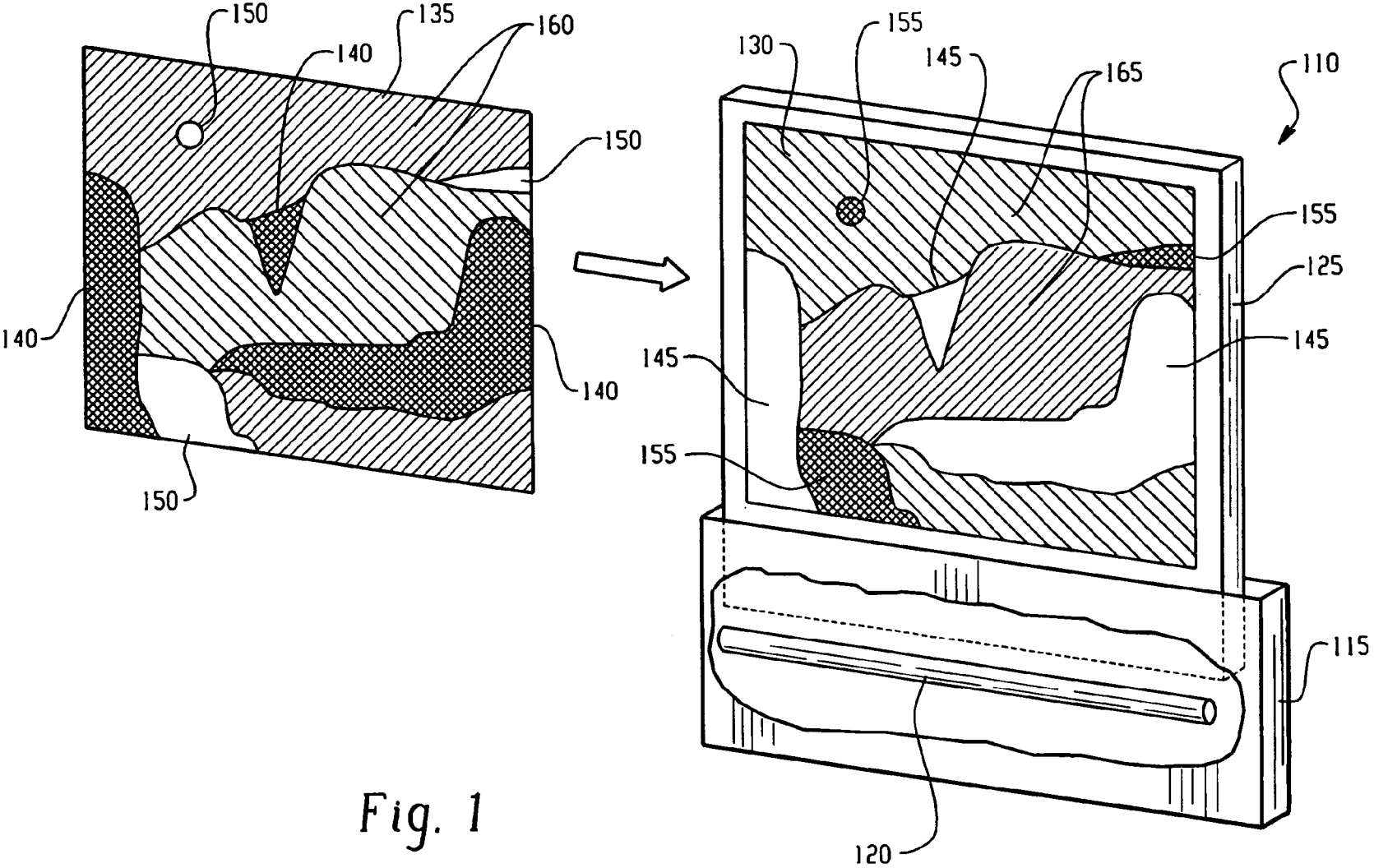
FIG. 1 is a cut-away view of an illuminated display device displaying a converted image in accordance with one embodiment of the present invention.

The following includes definitions of exemplary terms used throughout the disclosure. Both singular and plural forms of all terms fall within each meaning. Except where noted otherwise, capitalized and non-capitalized forms of all terms fall within each meaning:

As used herein, "software" and/or "program," as such relates to a computer, are used generically and include but are not limited to one or more computer executable instructions, routines, algorithms, modules or programs including separate applications or from dynamically linked libraries for performing functions as described herein. Software may also be implemented in various forms such as a servlet, applet, stand-alone, plug-in or other type of application. Software can be maintained on various computer readable mediums as known in the art.

As used herein, "logic" is used generically and includes but is not limited to hardware, software and/or combinations of both to perform a function.

As used herein, "white" is used generically and includes substantially achromatic colors of greatest lightness. As such particularly relates to the conversion of black and white images to halftone black and white images by a computer graphics software program as described herein, "white" includes all colors of an image which are deemed by the computer graphics software program to be substantially achromatic colors of greatest lightness and/or any areas and/or cells of an image which comprise color and/or black in amount below a threshold amount at which such areas or cells would be considered by such computer graphics software program to be a halftone.

As used herein, "black" is used generically and includes substantially achromatic colors of least lightness. As such particularly relates to the conversion of black and white images to halftone black and white images by a computer graphics software program as described herein, "black" includes all colors of an image which are deemed by the computer graphics software program to be substantially achromatic colors of least lightness and/or any areas and/or cells of an image which comprise a mixture of colors and/or black in amount above a threshold amount at which such areas or cells would be considered by such computer graphics software program to be a halftone.

As used herein, "gray," "partially white," "shading" or a "mixture of black and white" are used interchangeably and used generically, and include a series of neutral chromatic colors ranging between black and white.

In one embodiment, the present invention includes an illuminated display device and a method for providing display images therefor. The invention provides a method for converting an original image into at least one silk screen image for display upon an illuminated display device. The silk screen image representation of the original image provides highlights of white and partially white areas of the original image. Such highlights shine brightly to a viewer of an illuminated display device of the present invention.

Illustrated in FIG. 1 is a cut-away view of an illuminated display device of the present invention. Illuminated display device 110 has a base 115, an illumination source 120 contained within base 115, and an image-bearing medium 125 supported (and preferably contained) by base 115. An edge of medium 125 is in close proximity with illumination source 120, so that illumination passes through the medium in a direction generally parallel to a surface of the medium and illuminates an image 130 applied or affixed to the medium 125. As described below, image 130 is converted from original image 135.

Base 115 may be made from a material which is generally opaque, can safely contain illumination source 120, and is sturdy enough to maintain image-bearing medium 125 in close proximity to illumination source 120, including but not limited to a suitable black molded plastic, such as styrene, or any suitable aluminum or other metal. Base 115 may also contain a power source (not shown) for illumination source 120, such as a self-contained battery power system or a power converter for obtaining electricity for an exterior source, such as a common electrical wall socket. Base 115 may be any suitable shape and size for containing illumination source 120 and maintaining image-bearing medium 125 in close proximity thereto. It will be appreciated that certain features may be included in the base 115, including but not limited to a clock, a clock/alarm, an LED clock/alarm, a radio or a digital sound device.

Illumination source 120 is any suitable source of light, such as a fluorescent or incandescent light bulb, or series of such light bulbs. Illumination source 120 may provide any suitable form of light, including, but not limited to, white light, fluorescent light, colored light or black light. Illumination source 120 may be shaped to be roughly the same length as a side of image-bearing medium 125 which is contained within base 125, so that generally uniform light shines into generally all of such side. Alternatively, multiple bulbs may be spaced so that light is evenly dispersed into generally all of such side, or alternatively, illumination source 120 may be restricted to a part or certain parts of such side, so as to unevenly shine light into generally all of such side. It will be appreciated that a single reflective surface or a plurality of reflective surfaces may be used to amplify or redirect light from illumination source 120. Such reflective surfaces may direct light into medium 125 as known in the art. Such reflective surfaces may be contained in base 125 and in close proximity to illumination source 120.

Image-bearing medium 125 is made from any suitable generally clear material, such as glass, acrylic or other plastic. Image-bearing medium 125 may be any suitable size, shape and thickness that is suitable for propagating illumination through the center of the medium. In an embodiment of the present invention, image-bearing medium 125 is acrylic, roughly rectangular in shape, and about ¼ of an inch thick.

A part of image-bearing medium 125 is retained within base 115 so that image-bearing medium 125 may be maintained in an upright, fixed position and may further be biased in close proximity with illumination source 120. An edge or multiple edges of image-bearing medium 125 may be in contact with illumination source 120 or may be closely situated thereto. Light may emit from illumination source 120 in multiple directions. Generally opaque base 125 contains a certain amount of such light, and some of this light propagates into image-bearing medium 125 through the edge or edges in close proximity to illumination source 120. Reflectors as described herein may be used to redirect certain amounts of light into medium 125.

A certain percentage of light that enters image-bearing medium 125 from such edge or edges propagates through image-bearing medium 125. A certain amount of such light will reach the air surrounding image-bearing medium 125. If the angle at which the light strikes the air is less than the angle of refraction for the material which comprises image-bearing medium 125, such light will "bounce" off the air and continue propagating through image-bearing medium 125. If the angle at which the light strikes the air is greater than the angle of refraction, such light will escape image-bearing medium 125 at such point and begin propagating through the surrounding air. Unless a viewer of the illuminated display is positioned so that such refracted light propagates directly to such a viewer, the viewer will not perceive such light. If, however, image-bearing medium has certain ink applied or affixed thereto, as set forth below, and such light strikes the ink before striking the air, the light will be diffused by the ink. A percentage of such diffused light will reach a viewer of the display device, thus giving such inked portions a highlighted appearance.

Image 130 is affixed to a face of image-bearing medium 125 by a method as described below. Image 130 may be affixed to the front or rear face of image-bearing medium 125. Image 130 is converted from original image 135 by a method illustrated in FIG. 2.

Figure 2:
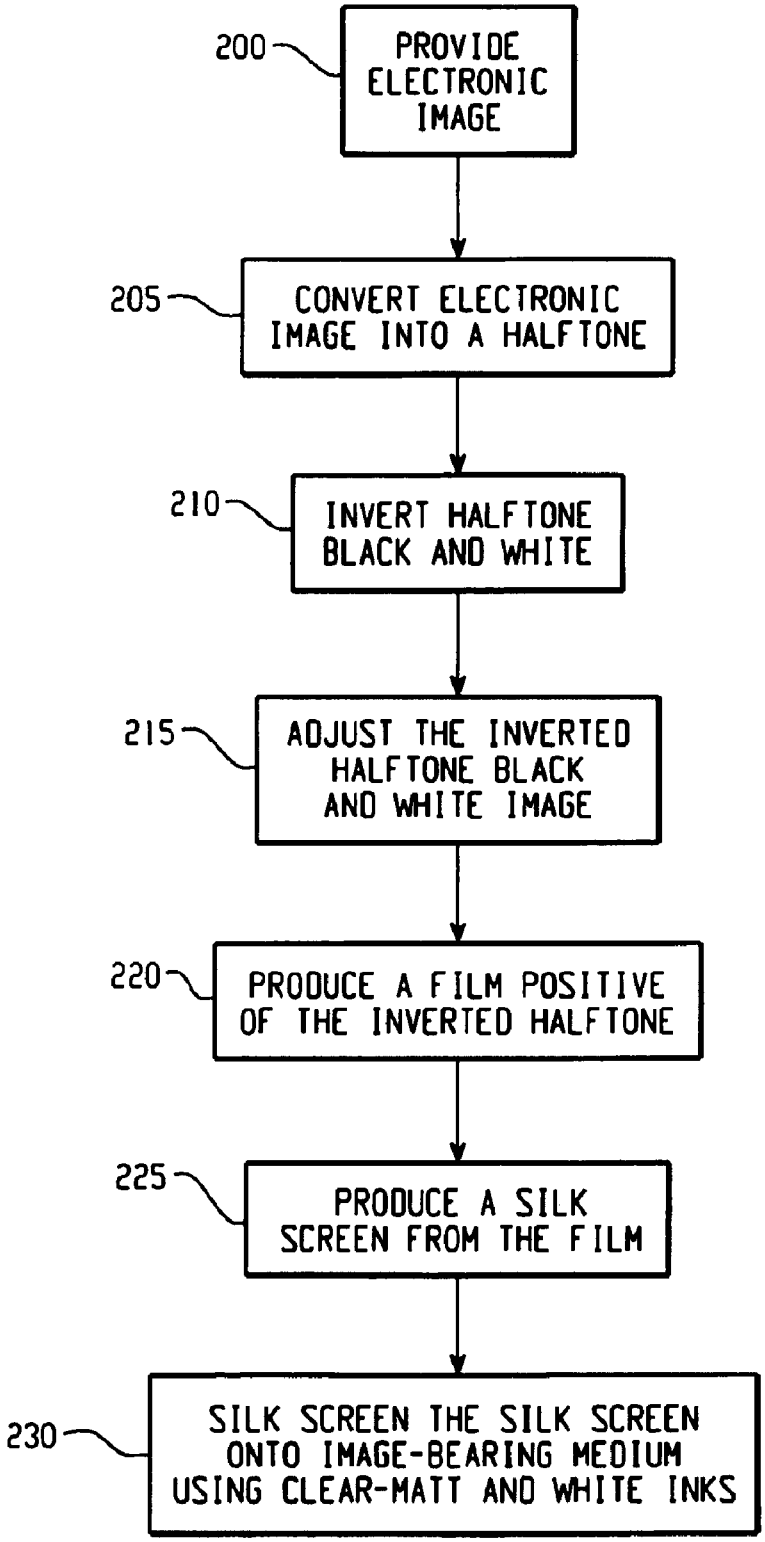
FIG. 2 is an exemplary methodology for providing an image for an illuminated display device in accordance with one embodiment of the present invention.

Illustrated in FIG. 2 is an exemplary methodology for providing image 130 for image-bearing medium 125 from original image 135 in accordance with one embodiment of the present invention. The blocks shown represent functions, actions or events performed therein.

At block 200 an electronic image is provided. The electronic image may be color or black and white. The term "electronic image," as used herein, means a computer-readable image created, altered, organized, stored and/or compressed in any suitable format known to one skilled in the art, such as an Adobe Photoshop® file (*.psd) or and Adobe Illustrators file (*.ai). The electronic image may be an original image created electronically by any suitable computer application or device, including, but not limited to, graphics illustration software, digital imaging and digital photography. The electronic image may also be an original image which is scanned into an electronic format by any suitable scanning device and associated scanning software and may be made available for further processing by any suitable method, including storage on computer-readable media or storage in computer RAM. In an embodiment, an electronic image is scanned into a computer using a flat-bed scanner and a commercially available graphics software program, such as Adobe Photoshop®. The scanned image is stored in electronic format in computer memory by the graphics software program.

At block 205 the electronic image is converted into a halftone black and white image. If the electronic image is a color image, the color image is first converted into a black and white image by any suitable method, including electronic conversion by any suitable computer graphics software program. In an embodiment, the scanned image is converted to a black and white image by a computer graphics software program which stores a color original scanned image in computer memory. The converted black and white image is further stored in electronic format in computer memory by the computer graphics software program.

A halftone black and white image is a representation of an original black and white image wherein any white of the original black and white image is represented by white in the halftone black and white image, any black of the original black and white image is represented by black in the halftone black and white image, and any gray or shading of the original black and white image is represented by a corresponding halftone in the halftone black and white image. Halftone images may be produced by superimposing a grid over the original image and filling each cell of the grid with varying amounts of shading (or white) to represent the shading of the portion of the original which corresponds to the cell. The conversion to a halftone black and white image may also be achieved by any suitable computer graphics software program using any suitable conversion methodology known to one skilled in the art. For example, an area of the black and white image which appears white to a human viewer may actually comprise a certain small percentage of black. The computer graphics software program uses well-known methodologies to assign a white cell in the halftone black and white image to such a "white" area in the black and white image wherein the black contained in such an area is below a defined threshold. A similar methodology may be used for small amounts of white in a black area. In an additional example, areas in the black and white image which appear as gray to the human eye may be composed electronically as a certain percentage of black and a certain percentage of white. The computer graphics software program uses well-known methodologies to assign a particular halftone to a cell which represents such an area. The particular halftone selected corresponds to the level of gray perceived, which is actually a percentage composite of black and white in the area of the black and white image which corresponds to the cell. In an embodiment, a black and white image stored in computer memory by a computer graphics software program is converted to a halftone black and white image by the computer graphics software program and further stored in computer memory by the computer graphics software program.

At block 210 the halftone black and white image is inverted by inverting or reversing the halftones representing the halftone black and white image. In the resulting inverted halftone black and white image, any black represents white in the original halftone black and white image, any white represents black in the original halftone black and white image, and any halftone represents the inverted halftone in the original halftone black and white image. The inversion of the halftones may be accomplished by any suitable method known in the art, including by any suitable computer graphics software program known to one skilled in the art. In an embodiment, a halftone black and white image stored in computer memory by a computer graphics software program is inverted by the computer graphics software program and the inverted halftone black and white image is further stored in computer memory by the computer graphics software program.

At block 215 the inverted halftone black and white image is optionally adjusted to accommodate screen printing as described below. Optional adjustments include any suitable graphical adjustments to the inverted halftone black and white image, including but not limited to adjustments to the frequency, angle, size and shape of the inverted halftone black and white image. In an embodiment, the frequency, angle, size and shape of the inverted halftone black and white image is adjusted to accommodate screen printing onto glass or acrylic of a particular size and shape and to reduce or eliminate moiré patterns. The adjustments may be accomplished by any suitable method known in the art, including by any suitable computer graphics software program known to one skilled in the art. In an embodiment, the frequency, angle, size and shape of an inverted halftone black and white image stored in computer memory by a computer graphics software program is adjusted by the computer graphics software program and the adjusted, inverted halftone black and white image is further stored in computer memory by the computer graphics software program.

At block 220 a film positive of the inverted halftone black and white image is created. A "film positive" is a representation of an image on film wherein the colors, blacks and whites are accurately reproduced rather than reproduced in negative, inverted or otherwise altered. The film positive is created from the inverted halftone black and white image by any suitable method known in the art. In an embodiment, an inverted halftone black and white image stored in computer memory by a computer graphics software program is printed out by a computer printer at the direction of the computer graphics software program. Printing is either achieved directly onto film by a computer printer capable of printing onto film or onto an intervening media, such as paper, and then transferred to film by any suitable method known in the art.

At block 225 a silk screen is produced from the film positive. The silk screen may be produced from the film positive by any suitable method known in the silk screening arts. In the silk screen produced from the film positive, any black areas on the film positive are represented by pervious printing areas of the silk screen, any white areas on to film positive are represented by impervious nonprinting areas of the silk screen, and any halftone areas on the film positive are represented by correspondingly partially pervious printing areas of the silk screen. As used herein, a "pervious printing area" means an area of a silk screen wherein each cell which comprises such area is completely open, thus allowing ink which is subsequently squeezed through such cell to be affixed to a medium across the greatest area allowable by such cell. As further used herein, a "partially pervious printing area" means an area of a silk screen wherein each cell which comprises such area is open to some extent less than completely, thus allowing ink which is subsequently squeezed through such cell to be affixed to a medium across an area of such cell lesser than the complete area allowable by such cell. In an embodiment, the silk screen comprises a synthetic screening material covered with a photo-sensitive coating. The photo-sensitive silk screen is exposed to the film positive and light for a suitable period of time until the film positive is reproduced upon the silk screen.

In an embodiment, it will be appreciated that a silk screen may be produced from an electronic form of the inverted halftone black and white image by use of a machine capable of providing a silk screen from an electronic image. Such a machine is available from KIWO, Inc. and generally identified as a direct emulsion machine.

At block 230 the silk screen is silk screened onto the image-bearing medium using a mixture of at least clear-matt and white inks. A clear-matt ink may be any commercially available clear-matt ink and/or any clear ink with a clear-matt powder mixed therewith. The silk screen may be silk screened onto the image-bearing medium by any suitable silk screening method known in the silk screening arts, including, but not limited to, any suitable automated silk screening machine. In an embodiment, the silk screen is placed onto a face of the image-bearing medium and a mixture of clear-matt and white inks is placed on top of the silk screen. Using a squeegee, the ink mixture is spread evenly across the silk screen and pressed into the silk screen so that a certain amount of ink mixture is transferred onto the image-bearing medium through pervious and partially pervious printing areas of the silk screen. The silk screen is removed from the image-bearing medium and the ink silk screened onto the image-bearing medium is dried by any suitable method known in the art, including but not limited to air drying, ultra-violet light drying or heat drying.

The ink mixture is any suitable mixture of clear-matt and white inks. In an embodiment, the ink mixture is a textured ultra-violet, vinyl or similar ink suitable for printing on acrylic or glass and containing about 10% white additive (ink) and about 90% clear-matt finish (ink). As placed upon a face of an image-bearing medium in a display device of the present invention, the ink mixture diffuses light when such light contacts the ink mixture after propagating through the interior of the image-bearing medium.

The ink mixture may also contain a clear or white fluorescent ink. Such a fluorescent ink will emit light upon absorbing light which is propagating through medium 125. In an embodiment, a fluorescent ink which emits blue-white light is used. The emission if blue-white light gives a viewer the impression that an ink mixture which contains such is whiter than an ink which does not contain such, because an ink without such will appear more yellow by comparison. The ink mixture may also contain a clear or white phosphorescent ink. Such a phosphorescent ink will emit light following absorption of light propagating through medium 125 and subsequent removal of such light.

Referring again to FIG. 1, the image-bearing medium 125 with silk-screened image 130 thereon is biased in base 115 in close proximity with illumination source 120 whereby light from illumination source 120 enters image-bearing medium 125 through an edge thereof. Such light propagates through image-bearing medium 125 until it leaves through a clear part of a face of image-bearing medium 125 or until it is diffused by contact with a part of the ink mixture affixed onto a face of image-bearing medium 125.

The conversion of original image 135 to silk-screened image 130 is noted. Original image 135 is either a black and white original or a color original that has been converted to a black and white original as described herein. Generally black areas 140 of original image 135 are represented by clear areas 145 of silk-screened image 130. Clear areas 145 of silk-screened image 130 do not diffuse light propagating within image-bearing medium 125, and thus do not appear as bright or highlighted to a viewer of the silk-screened image. Generally white areas 150 of original image 135 are represented by inked areas 155 of silk-screened image 130. Inked areas 155 of silk-screened image 130 diffuse light propagating within image-bearing medium 125, thus appearing bright and highlighted to a viewer of the silk-screened image. Halftone areas 160 of original image 135 are represented by correspondingly inverted halftone partially inked areas 165 of silk-screened image 130. To the extent halftone partially inked areas 165 of silk-screened image 130 contain ink, such areas diffuse light propagating within image-bearing medium 125, thus appearing bright and highlighted to a viewer of the silk-screened image, but not as bright or highlighted as a white area 155 of silk-screened image 130.

Figure 3:
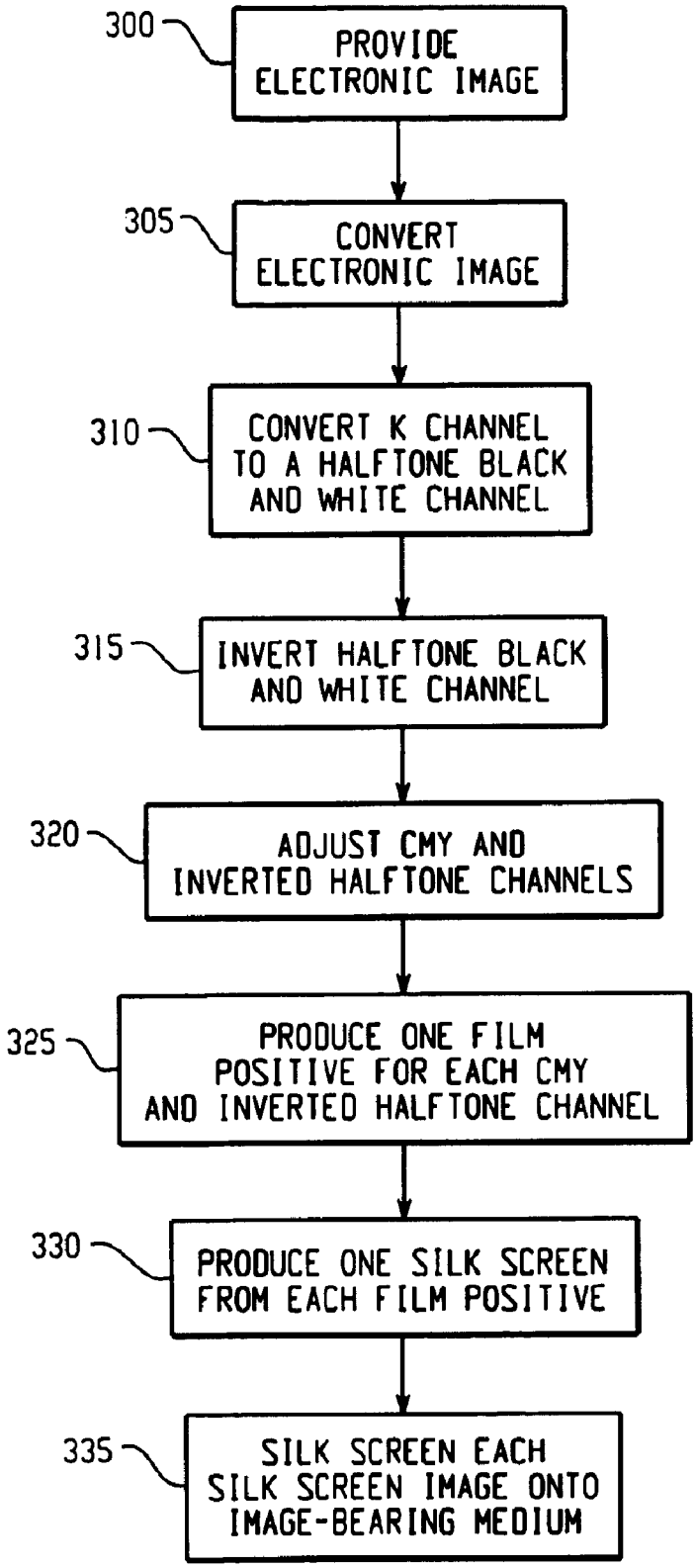
FIG. 3 is an exemplary methodology for providing a color image for an illuminated display device in accordance with one embodiment of the present invention.

Illustrated in FIG. 3 is an exemplary methodology for providing a color image 130 for image-bearing medium 125 from a color original image 135 in accordance with one embodiment of the present invention.

At block 300 an electronic color image is provided. The electronic image may be an original image created electronically by any suitable computer application or device, or may be an original image which is scanned into an electronic format by any suitable scanning device and associated scanning software. In an embodiment, the electronic image is stored in computer memory by a graphics software program.

At block 305 the electronic color image is converted into a CMYK file. A "CMYK file" for the purposes of this invention is an electronic, computer-readable file for electronically representing a color image. In a CMYK file, a color image is represented by four "channels," also referred to as plates, films or screens, each of which represents one basic color, the combination of which comprises the color image. The "C" channel of a CMYK file represents the cyan component of the color image. The "M" channel of a CMYK file represents the magenta component of the color image. The "Y" channel of a CMYK file represents the yellow component of the color image. The "K" channel of a CMYK file represents the black component of the color image. Each channel is individually modifiable, separately and distinctly from the other channels. The conversion of the color original image may be accomplished by any suitable method known in the art, including by any suitable computer graphics software program known to one skilled in the art. In an embodiment, a color image in electronic format stored in computer memory by a computer graphics program is converted into a CMYK file by the computer graphics software and the CMYK file, including all four individual color channels, is further stored in computer memory by the computer graphics software program.

At block 310 the K channel of the CMYK file is converted into a halftone black and white channel. In such a conversion, any white portions of the K channel of the CMYK file are represented by white in the halftone black and white channel, any black of the K channel of the CMYK file is represented by black in the halftone black and white channel, and any areas comprising a mixture of white and black of the K channel of the CMYK file corresponding to a single cell of the K halftone black and white channel is represented by a corresponding halftone in the K halftone black and white channel. The conversion to the K halftone black and white channel may be achieved by any suitable computer graphics software program known to one skilled in the art. In an embodiment, a K channel of a CMYK file stored in computer memory by a computer graphics software program is converted to a halftone black and white channel by the computer graphics software program and further stored in computer memory by the computer graphics software program.

At block 315 the halftone black and white channel is inverted by inverting or reversing the halftones representing the halftone black and white channel. In the resulting inverted halftone black and white channel, any black represents white in the original halftone black and white channel, any white represents black in the original halftone black and white channel, and any halftone represents the correspondingly inverted halftone in the original halftone black and white channel. The inversion of the halftones may be accomplished by any suitable method known in the art, including by any suitable computer graphics software program. In an embodiment, a halftone black and white channel stored in computer memory as part of a CMYK file by a computer graphics software program is inverted by the computer graphics software program and the inverted halftone black and white channel is further stored in computer memory by the computer graphics software program.

At block 320 each of the C channel, the M channel, the Y channel and the inverted halftone black and white channel is optionally adjusted to accommodate screen printing as described below. Optional adjustments include any suitable graphical adjustments of any graphical property, including but not limited to the frequency, angle, size and shape. In an embodiment, the frequency, angle, size and shape of each of the channels is adjusted to accommodate screen printing onto glass or acrylic of a specific size and shape and to reduce or eliminate moiré patterns. The adjustments may be accomplished by any suitable method known in the art, including by any suitable computer graphics software program. In an embodiment, the frequency, angle, size and shape of each of the channels stored in computer memory by a computer graphics software program is adjusted by the computer graphics software program and the adjusted channels are further stored in computer memory by the computer graphics software program.

At block 325 a film positive of each of the C channel, the M channel, the Y channel and the inverted halftone black and white channel is created. Thus, four film positives are created by any suitable method known in the art. In an embodiment, each channel stored in computer memory by a computer graphics software program is printed out by a computer printer at the direction of the computer graphics software program. Printing is either achieved directly onto film by a computer printer capable of printing onto film or onto an intervening media, such as paper, and then transferred to film by any suitable method known in the art.

At block 330 a silk screen is produced from each of the film positives. Thus, at least four silk screens are produced. The silk screen may be produced from the film positive by any suitable method known in the silk screening arts. It will be appreciated by one skilled in the art that additional silk screens may be required to reproduce certain colors. As known in the art, certain "spot" colors, such as brown and/or purple, may require the use of additional silk screens to accurately produce certain colors. In the silk screen produced from the inverted halftone black and white film positive, any white areas on the inverted halftone film positive are represented by pervious printing areas of the silk screen, any black areas on the inverted halftone film positive are represented by impervious nonprinting areas of the silk screen, and any halftone areas on the inverted halftone film positive are represented by correspondingly partially pervious printing areas of the silk screen.

In an embodiment, it will be appreciated that a silk screen for each channel may be produced from an electronic form of each channel by use of a machine capable of producing a silk screen from an electronic image.

At block 335 each of the silk screens are silk screened onto the image-bearing medium. The inverted halftone silk screen is silk screened using a mixture of at least clear-matt and white inks. As described elsewhere herein, fluorescent and/or phosphorescent inks may also be added to the mixture. The Y silk screen is silk screened using any suitable translucent yellow ink. The M silk screen is silk screened using any suitable translucent magenta ink. The C silk screen is silk screened using any suitable translucent cyan ink. The silk screens may be silk screened onto the image-bearing medium by any suitable silk screening method known in the silk screening arts.

Each of the four silk screens is silk screened on top of the other. Any suitable method or form of alignment may be used to ensure that each silk screen is properly silk screened. In an embodiment, each silk screen contains registration marks which allow for proper alignment of each silk screen. Each silk screen is aligned on the image-bearing medium according to such registrations marks so that each succeeding silk screen will be properly aligned over the preceding silk screens to ensure a final image reproduction without misaligned colors. Each of the four silk screens are silk screened in any appropriate sequence. In an embodiment wherein the image is affixed to the front face of the image-bearing medium, the silk screens may be silk screened in the following order: inverted halftone first, Y second, M third and C fourth. In an embodiment wherein the image is affixed to the back face of the image-bearing medium, the silk screens may be silk screened in the following order: C first, M second, Y third and inverted halftone fourth.

The ink mixture for the inverted halftone silk screen is any suitable mixture of clear-matt and white inks. In an embodiment, the ink mixture is a textured ultra-violet, vinyl or similar ink suitable for printing on acrylic or glass and containing about 10% white additive (ink) and about 90% clear-matt finish (ink). The ink for the Y, M and C silk screens may be, respectively, any suitable translucent textured ultra-violet, vinyl or similar yellow, magenta or cyan ink suitable for printing on acrylic or glass.

Figure 4:
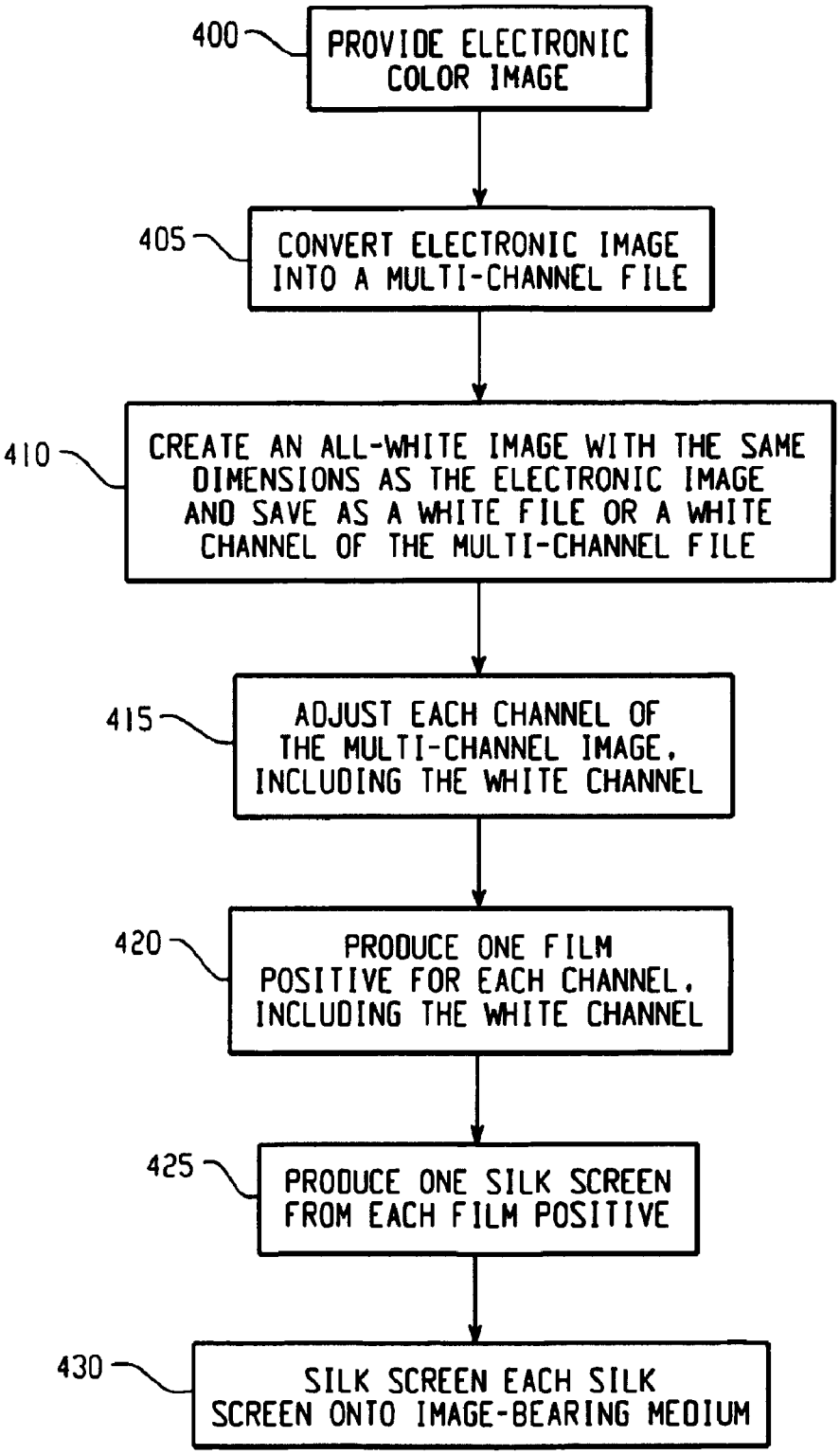
FIG. 4 is an exemplary methodology for providing a color image for an illuminated display device in accordance with another embodiment of the present invention.

Illustrated in FIG. 4 is an exemplary methodology for providing a color image 130 for image-bearing medium 125 from a color original image 135 in accordance with one embodiment of the present invention.

At block 400 an electronic color image is provided. The electronic image may be an original image created electronically by any suitable computer application or device, or may be an original image which is scanned into an electronic format by any suitable scanning device and associated scanning software. The electronic image may be stored in computer memory by a graphics software program.

At block 405 the electronic color image is converted into a multi-channel file wherein each channel represents a color which is contained in the image. A multi-channel file for the purposes of this invention is an electronic, computer-readable file for electronically representing a color image. In a multi-channel file, a color image is represented by a plurality of "channels," also referred to as plates, films or screens, each of which represents one basic color, the combination of which comprises each and every color displayed in the image. The multi-channel file may be any suitable multi-channel combination of colors known in the art. For example, two suitable multi-channel formats are a "CMYK file," as previously described herein, and an "RGB file". While a CMYK file contains four channels, each representing the color cyan, magenta, yellow and black respectively, an RGB file contains three channels, each representing the color red, green and blue respectively. As with a CMYK file, in an RGB file each channel is individually modifiable, separately and distinctly from the other channels.

The conversion of the color original image into a multi-channel file may be accomplished by any suitable method known in the art, including by any suitable computer graphics software program known to one skilled in the art. In an embodiment, a color image in electronic format stored in computer memory by a computer graphics program is converted into a CMYK file by the computer graphics software and the CMYK file, including all four individual color channels, is further stored in computer memory by the computer graphics software program. In another embodiment, a color image in electronic format stored in computer memory by a computer graphics program is converted into a RGB file by the computer graphics software and the RGB file, including all three individual color channels, is further stored in computer memory by the computer graphics software program.

At block 410 an all-white image is created. The all-white image is created to generally duplicate the shape and dimensions of each channel of the multi-channel file. For example, if the channels of the multi-channel file are generally rectangular in shape and about 4 inches high and about 5 inches wide, the all-white image is created generally rectangular in shape and about 4 inches high and about 5 inches wide. Similarly, if the channels of the multi-channel file are generally circular with about a 5 inch diameter, the all-white image is created generally circular in shape with about a 5 inch diameter. Creation of the all-white image may be achieved by any suitable computer graphics software program known to one skilled in the art. The all-white image may be stored in any suitable format, including as an additional channel added into the multi-channel image file. Alternatively, the all-white image may be stored as an additional file, separate and distinct from the multi-image file. While further description of the present embodiment will be limited to maintenance of the all-white image as an additional channel of the multi-channel file, it will be appreciated that one skilled in the art could perform the steps described below with the all-white image stored as a separate file.

In an embodiment, the all-white image is created with the same shape and size as the original image by a computer graphics software program and is stored in computer memory as an additional channel in the multi-channel file by the computer graphics software program.

At block 415 each channel of the multi-channel file, including the all-white channel, is optionally adjusted to accommodate screen printing as described below. Optional adjustments include any suitable graphical adjustments, including but not limited to adjustments to the frequency, angle, size and shape. The size and shape of the all-white channel may be adjusted to be larger in certain dimensions than the remaining channels if a white border is desired around the resulting image. In an embodiment, the frequency, angle, size and shape of each of the channels is adjusted to accommodate screen printing onto glass or acrylic of a certain size and shape and to reduce or eliminate moiré patterns. The adjustments may be accomplished by any suitable method known in the art, including by any suitable computer graphics software program. In an embodiment, the frequency, angle, size and shape of each of the channels stored in computer memory by a computer graphics software program is adjusted by the computer graphics software program and the adjusted channels are further stored in computer memory by the computer graphics software program.

At block 420 a film positive of each of the channels of the multi-channel file is created by any suitable method known in the art. For a CYMK file with the additional all-white channel, five film positives will be created. For an RGB file with the additional all-white channel, four film positives will be created. In an embodiment, each channel stored in computer memory by a computer graphics software program is printed out by a computer printer at the direction of the computer graphics software program. Printing is either achieved directly onto film by a computer printer capable of printing onto film or onto an intervening media, such as paper, and then transferred to film by any suitable method known in the art.

At block 425 a silk screen is produced from each of the film positives. For an original image which has been converted to a CYMK file, at least five silk screens are produced. For an original image which has been converted to an RGB file, at least four silk screens are produced. Each silk screen may be produced from the film positive by any suitable method known in the silk screening arts. It will be appreciated by one skilled in the art that additional silk screens may be required to produce certain colors, as set forth herein.

In an embodiment, it will be appreciated that a silk screen for each channel my be produced from an electronic form of each channel by use of a machine capable of producing a silk screen from an electronic image.

At block 430 each of the silk screens are silk screened onto the image-bearing medium. Each silk screen is silk-screened with a translucent ink which corresponds to the color of the channel which was used to produce the silk screen, except that any black channel may be silk screened with either a translucent or an opaque black ink, and the all-white channel may be silk screened using a mixture of clear-matt and white inks.

For an original image which has been converted to a CYMK file with an additional all-white channel, the all-white silk screen is silk screened using a mixture of clear-matt and white inks. The K silk screen is silk screened using any suitable translucent or opaque black ink. The Y, M and C silk screens are silk screened, respectively, using any suitable translucent yellow, magenta or cyan ink.

For an original image which has been converted to an RGB file with an additional all-white channel, the all-white silk screen is silk screened using a mixture of clear-matt and white inks. The R, B and G silk screens are silk screened using any suitable translucent red, blue or green ink.

Each of the silk screens is silk screened on top of the other. Any suitable method for alignment may be used to ensure that each silk screen is properly silk screened and positioned. In an embodiment, each silk screen contains registration marks which allow for proper alignment of each silk screen. Each silk screen is aligned on the image-bearing medium according to such registrations marks so that each succeeding silk screen will be properly aligned over the preceding silk screens to ensure a final image reproduction without misaligned colors.

Each of the silk screens are silk screened in any appropriate sequence. In an embodiment wherein the original image has been converted into a CMYK file and the resulting image is affixed to the front face of the image-bearing medium, the silk screens may be silk screened in the following order: all-white first, K second, Y third, M fourth and C fifth. In an embodiment wherein the original image has been converted into a CMYK file and the resulting image is affixed to the back face of the image-bearing medium, the silk screens may be silk screened in the following order: C first, M second, Y third, K fourth and all-white fifth. In an embodiment wherein the original image has been converted into an RGB file and the resulting image is affixed to the front face of the image-bearing medium, the silk screens may be silk screened in the following order: all-white first, R second, G third and B fourth. In an embodiment wherein the original image has been converted into an RGB file and the resulting image is affixed to the back face of the image-bearing medium, the silk screens may be silk screened in the following order: B first, G second, R third and all-white fourth.

The ink mixture for the all-white silk screen is any suitable mixture of clear-matt and white inks. In an embodiment, the ink mixture is a textured ultra-violet, vinyl or similar ink suitable for printing on acrylic or glass and containing about 10% white additive (ink) and about 90% clear-matt finish (ink). In an embodiment, the ink for the Y silk screen is any suitable translucent textured ultra-violet, vinyl or similar yellow ink suitable for printing on acrylic or glass. In an embodiment, the ink for the M silk screen is any suitable translucent textured ultraviolet, vinyl or similar magenta ink suitable for printing on acrylic or glass. In an embodiment, the ink for the C silk screen is any suitable translucent textured ultra-violet, vinyl or similar cyan ink suitable for printing on acrylic or glass. In an embodiment, the ink for the K silk screen is any suitable translucent or opaque textured ultra-violet, vinyl or similar black ink suitable for printing on acrylic or glass. In an embodiment, the ink for the R silk screen is any suitable translucent textured ultra-violet, vinyl or similar red ink suitable for printing on acrylic or glass. In an embodiment, the ink for the B silk screen is any suitable translucent textured ultra-violet, vinyl or similar blue ink suitable for printing on acrylic or glass. In an embodiment, the ink for the G silk screen is any suitable translucent textured ultra-violet, vinyl or similar green ink suitable for printing on acrylic or glass.

While the steps of this exemplary methodology have been described in a particular order, it will be appreciated that certain of the steps may be performed in any suitable order. For example, in an embodiment wherein the all-white image is stored in a separate file, the step for adjusting the all-white image may be performed at any time prior to creating the corresponding all-white silk screen.

In another embodiment, the present invention includes an illuminated transparency display device and a method and system for providing highlighted display of the transparency thereon and/or therein. A transparency is illuminated by placing the transparency in front of an illuminated white background-bearing medium. The white background-bearing medium has a silk screened white background affixed thereto which diffuses light and appears as highlighted to a viewer. Clear areas of the transparency, which relate to white areas of the image on the transparency, do not block the highlights of the white background-bearing medium, allowing such highlights to appear to a viewer as highlighted parts of the image on display. To a lesser extent, highlighted light illuminates translucent color parts of the transparency image. Such parts appear brightly to a viewer, but not as brightly as any highlighted area behind a clear transparency area. The invention provides several methods for creating the silk screened white background and converting original images into a transparency image for proper highlighted display. The invention also provides a system for creating and displaying highlighted transparencies.

Figure 5A:
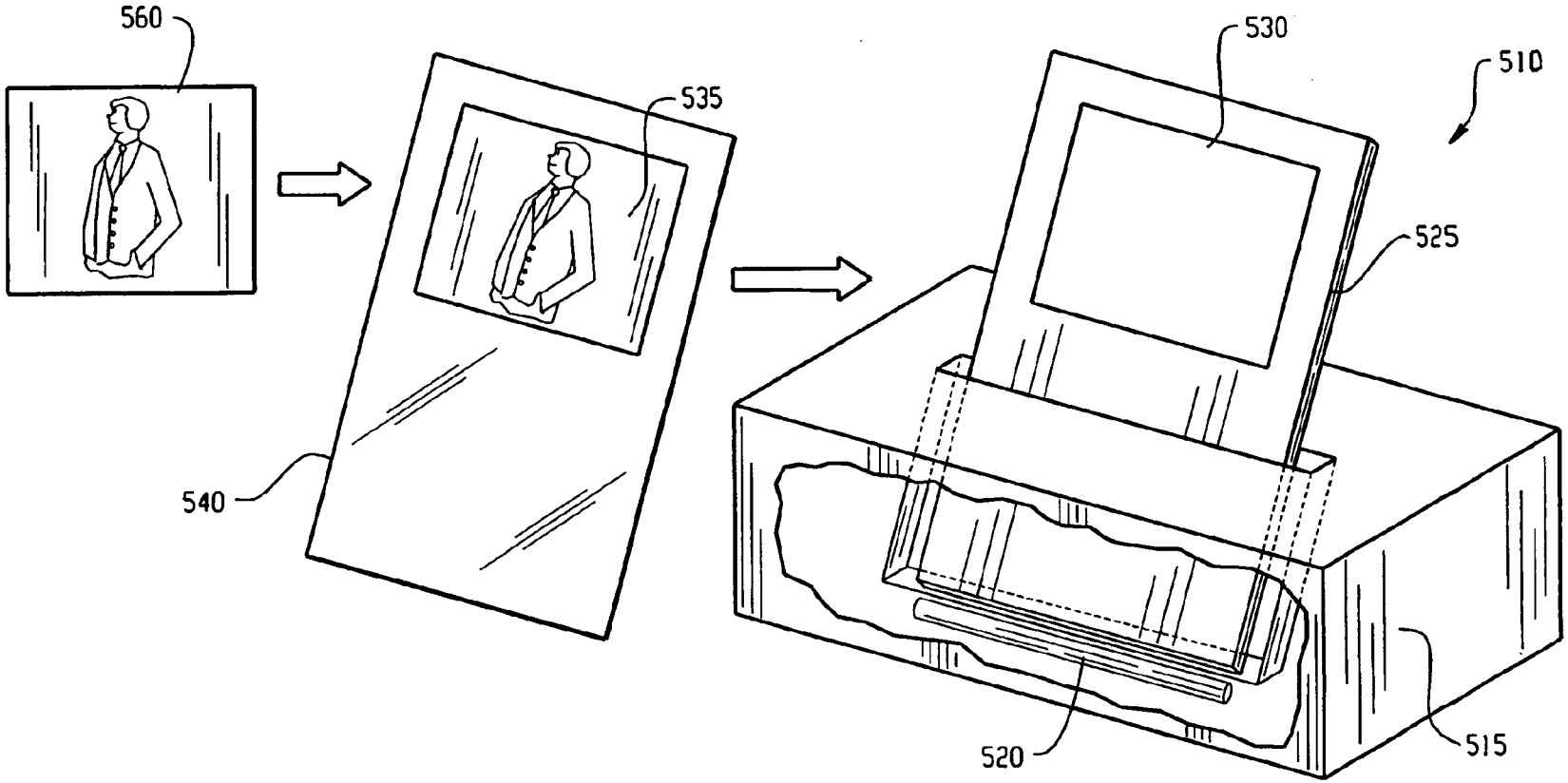
FIG. 5A is a cut-away view of an illuminated display device displaying a transparency in accordance with one embodiment of the present invention.
Figure 5B:
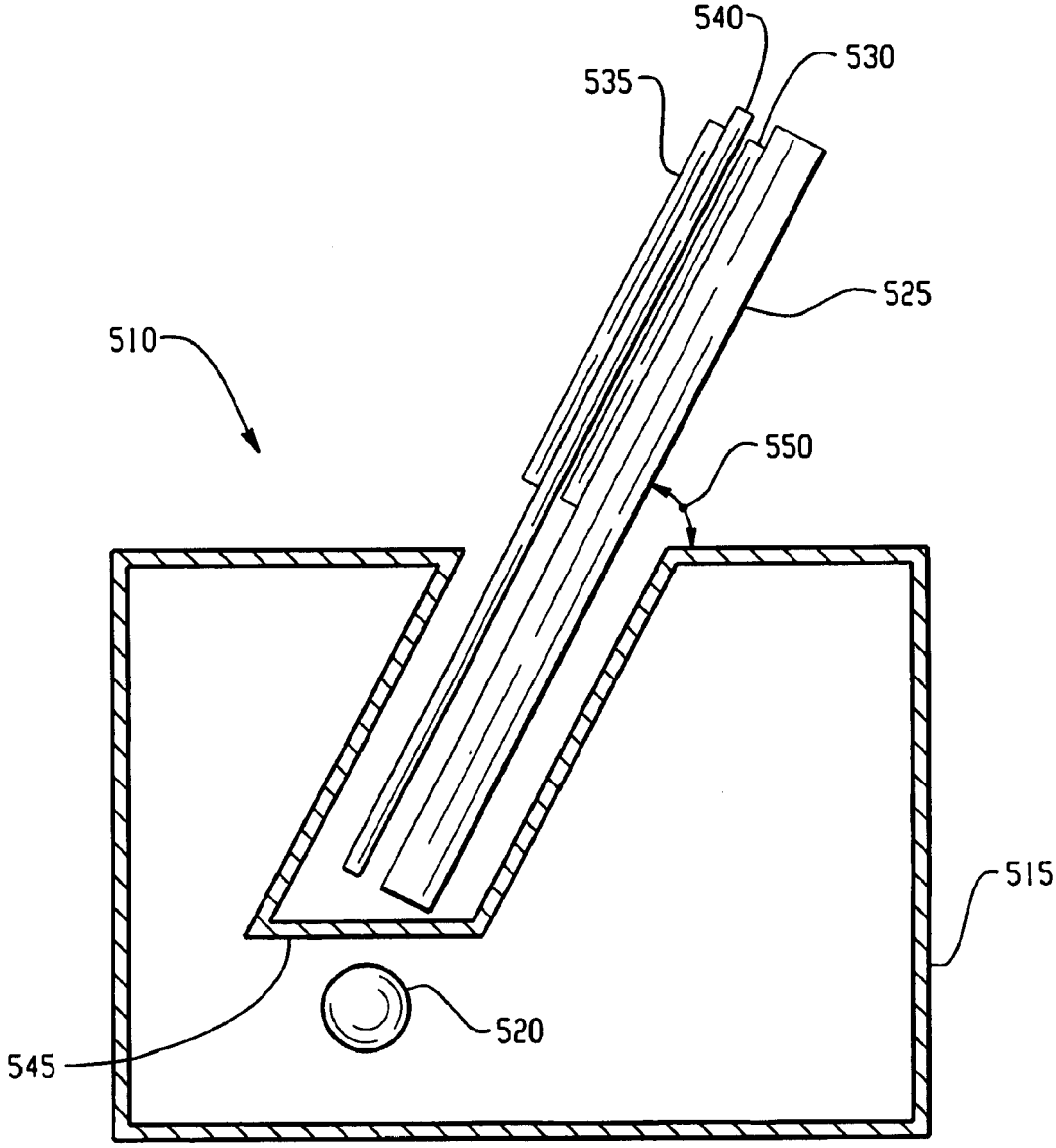
FIG. 5B is a cross-sectional view of a display device in accordance with one embodiment of the present invention.

With reference to both FIGS. 5A and 5B, illustrated in FIG. 5A is a cut-away view of an illuminated display device of the present invention and illustrated in FIG. 5B is a cross-sectional view of such a device. Illuminated display device 510 has a base 515, an illumination source 520 contained within base 515, and a white background-bearing medium 525 supported and partially retained by base 515 at an angle 550. Transparency 540 containing transparency image 535 is placed in front of white background-bearing medium 525 so that transparency image 535 is in front of a white silk-screened portion 530 of white background-bearing medium 525. Transparency 540 is supported and partially contained by base 515, base trough 545 and white background-bearing medium 525. An edge of medium 525 is in close proximity with illumination source 520, so that illumination passes through the medium in a direction generally parallel to a surface of the medium and illuminates white silk-screened portion 530 and transparency image 535. As described below, transparency image 535 is created from original image 560.

Base 515 may be made from any suitable material as described for a base of another embodiment of the present invention as described herein. Furthermore, base 515 may contain a power source, may be any suitable shape and size, and may contain certain features as described for a base of another embodiment of the present invention as described herein.

Base 515 has trough 545 therein. Trough 545 is sized and located to receive white background-bearing medium 525 and transparency 540. Trough 545 is shaped to receive both such at an angle of inclination 550. Angle of inclination 550 is any suitable angle whereby transparency 540, when placed in front of white background-bearing medium 525 and rested on the bottom of trough 545, will remain in a semi-upright position under normal viewing conditions without falling forward or otherwise falling away from white background-bearing medium 525. Trough 545 is further sized to contain a suitable portion of white background-bearing medium 545 and transparency 540 so as to maintain both such in a semi-upright position. As discussed further below, image-bearing medium 545 and transparency 540 are suitably sized so that the portions thereof containing transparency image 535 and white silk-screened portion 530, respectively, protrude above the upper face of base 515.

Trough 545 may also be shaped to receive white background-bearing medium 525 and transparency 540 generally normal to, or generally perpendicular to (i.e., wherein the angle of inclination 550 is 90°) the top face of base 515 (not shown). In such an embodiment, it will be appreciated that transparency 540 and white background-bearing medium 525 stand upright in base 515 and transparency 540 is retained against white background-bearing medium 525 by any suitable method or mechanism, including, but not limited to, static electricity, opaque or semi-translucent adhesive applied to the transparency an areas outside of transparency image 535, translucent adhesive, and/or any suitable retaining device, such as a clip or clips or a rubber band or rubber bands.

Illumination source 520 is any suitable form of light as described for an illumination source of another embodiment of the present invention as described herein. Furthermore, illumination source 520 may provide any suitable form of light, may be shaped in any suitable way, may have multiple bulbs, and may be restricted to illuminating certain parts of the medium as described for an illumination source of another embodiment of the present invention as described herein.

White background-bearing medium 525 is made from any suitable generally clear material, such as glass, acrylic or other plastic. White background-bearing medium 525 may be any suitable size, shape and thickness that is suitable for propagating illumination through the center of the medium. In an embodiment of the present invention, image-bearing medium 525 is acrylic, roughly rectangular in shape, and about ¼ of an inch thick.

A part of white background-bearing medium 525 is biased in close proximity with illumination source 520. An edge or multiple edges of white background-bearing medium 525 may be in contact with illumination source 520 or may be closely situated thereto. Light may emit from illumination source 520 in multiple directions. Generally opaque base 515 contains a certain amount of such light, and some of this light propagates into white background-bearing medium 525 through the edge or edges in close proximity to illumination source 520. Base 515 may also contain reflectors as described herein.

White background-bearing medium 525 has on a face thereof white silk-screened portion 530. White silk-screened portion 530 may be on the front face of the medium 525, with the "front" of the medium meaning the face of the medium upon which the transparency 540 is placed. White silk-screened portion 530 may be on the back face of the medium 525.

White silk-screened portion 530 may be the same shape and size as transparency image 535. For example, if the transparency image is generally rectangular in shape and about 4 inches high and about 5 inches wide, the white silk-screened portion 530 is generally rectangular in shape and about 4 inches high and 5 about inches wide. Similarly, if the original image is generally circular with about a 5 inch diameter, the white silk-screened portion is generally circular in shape with about a 5 inch diameter. As explained further herein, such uniformity in size and shape provides highlights behind the entire area of transparency image 535. White silk-screened portion 530 may be a different shape and/or smaller size than transparency image 535, but under such circumstances such parts of the transparency image (which are not backed by white silk-screened portion 530) will not be highlighted. It will be appreciated that the size and shape of the all white silk-screened portion 530 may be larger in certain dimensions than the transparency image. In such a situation, portions of white silk-screened portion 530 which are not covered by transparency image 535 will appear as a highlighted boarder around transparency image 535. In an embodiment, white silk-screened portion 530 is uniformly sized larger that transparency image 535 in order to create an even, highlighted boarder around transparency image 535. It will be appreciated that any portion of white silk-screened portion 530 which is below the top face of the base 515 will not be viewable to a viewer.

White silk-screen portion 530 is a mixture of clear-matt and white inks which are affixed onto a face of white background-bearing medium 525 by any suitable process, including several processes described herein. For example, the inks of white silk-screen portion 530 may be affixed by silk screening, painting (brush, spray or otherwise) and/or lithography. The ink is any suitable mixture of clear-matt and white inks. In an embodiment, the ink mixture is a textured ultra-violet, vinyl or similar ink suitable for printing on acrylic or glass and containing about 10% white additive (ink) and about 90% clear-matt finish (ink).

Referring to FIG. 5B, a certain percentage of light that enters white background-bearing medium 525 from and edge of medium 525 propagates through medium 525. A certain percentage of this propagating light propagates to a face of white background-bearing medium 525 where ink from white silk-screen portion 530 is affixed. Upon striking such ink, the light will be diffused. A certain percentage of such diffused light will travel to transparency 540 which is placed on top of and abutting the ink of white silk-screen portion 530. Such diffused light will permeate transparency 540 unless blocked by opaque or semi-opaque inks contained in transparency image 535. In clear areas of transparency image 535, the diffused light shines through, and a viewer of the display device may perceive such light as a highlight. Furthermore, to the extent translucent inks are used in transparency image 535, a certain amount of the diffused light will permeate such translucent inks, and a viewer of the display device may perceive such translucent ink portions as illuminated, particularly in comparison to areas covered by opaque ink.

Referring again to FIG. 5A, transparency image 535 is converted from original image 560 by a method as described below.

Figure 6:
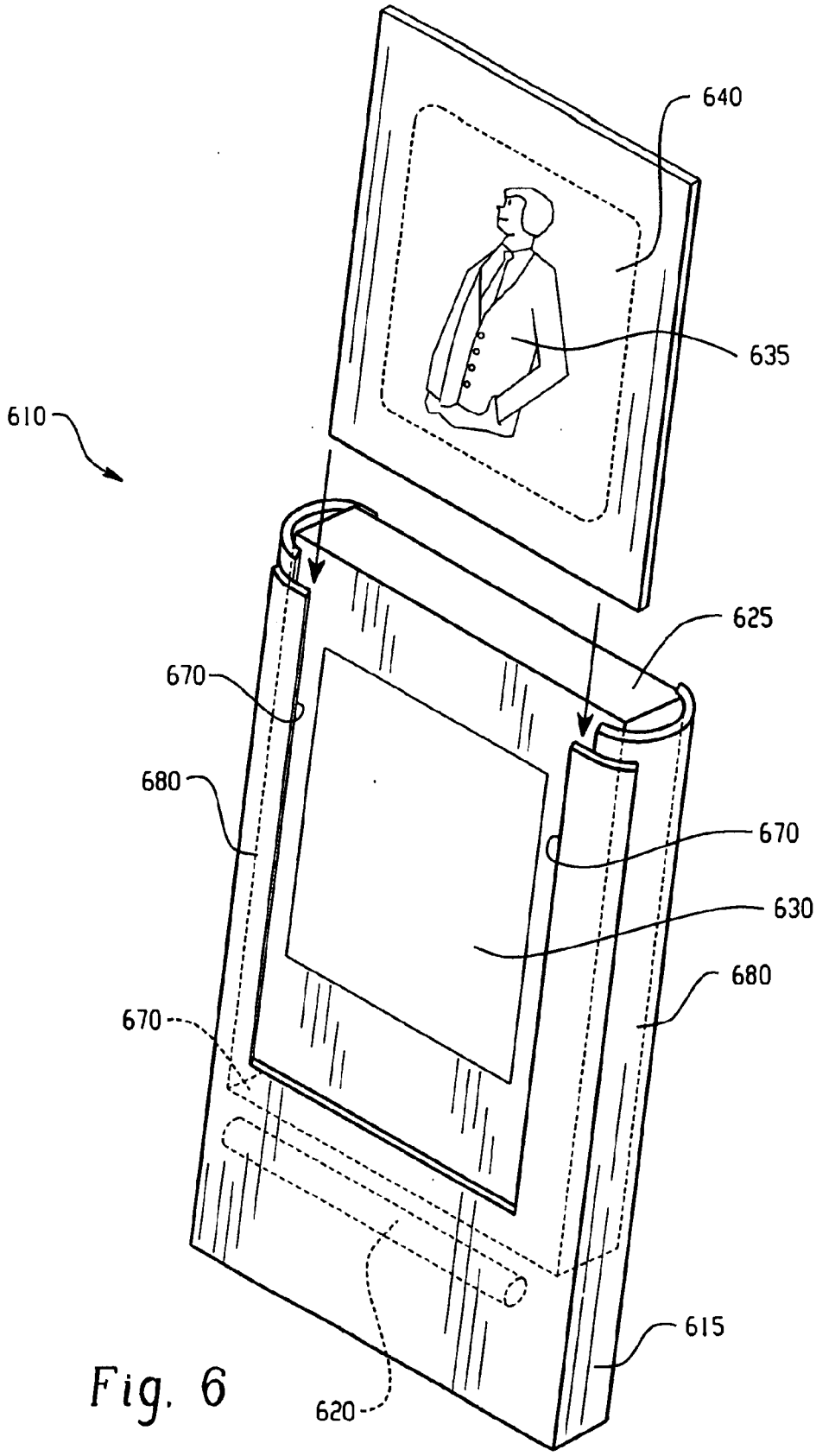
FIG. 6 is a perspective view of an illuminated display device displaying a transparency in accordance with yet another embodiment of the present invention.

With reference to FIG. 6, illustrated is a display device of the present invention wherein a transparency, medium and illumination source are maintained in a frame. Illuminated display device 610 has a frame 615 which retains white background-bearing medium 625, transparency 640 and illumination source 620. Transparency 640 is slidably removable from and retained in frame 615 by slot 670. White background-bearing medium 655 is slidably removable from and retained in frame 615 by slot 680.

Slots 680 and 670 are shaped and sized to fit transparency 640 and white background-bearing medium 625 so that transparency image 635 covers at least in part white silk-screened portion 630 of white background-bearing medium 625 when transparency 640 and medium 625 are retained in frame 615. Slots 680 and 670 are located within frame 615 so that transparency 640 is retained in front of medium 625 so that light diffusing from white silk-screened portion 630 will highlight certain areas of transparency image 635.

Illumination source 620 is contained in frame 615 whereby an edge of medium 625 is in close proximity to illumination source 620 whereby light passes into medium 625 as described herein.

Figure 7:
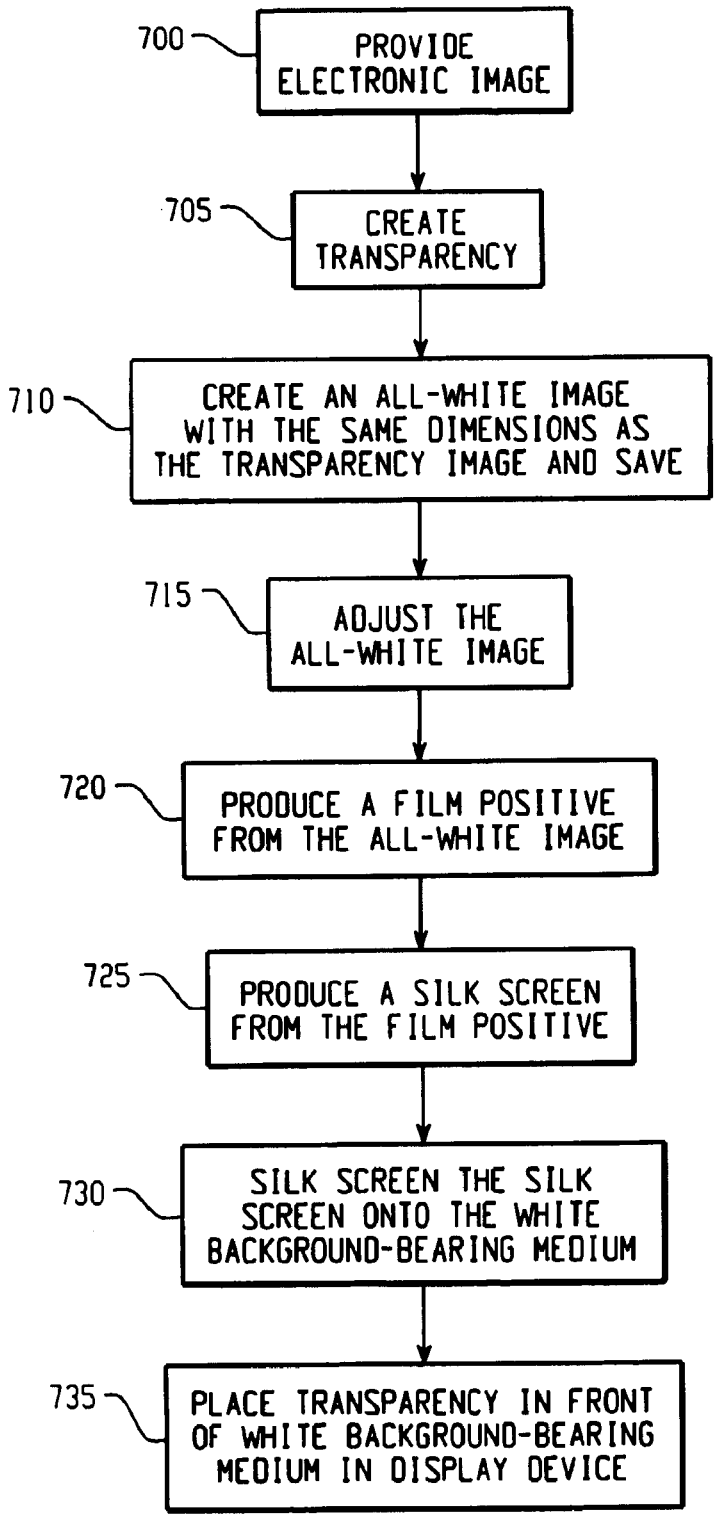
FIG. 7 is an exemplary methodology for providing an image for an illuminated display device in accordance with still another embodiment of the present invention.

Illustrated in FIG. 7 is an exemplary methodology for creating transparencies 540 or 640, transparency images 535 or 635 and white silk-screened portion 530 or 630 from an original image in accordance with one embodiment of the present invention.

At block 700 an electronic image is provided. The electronic image may have color and/or black and white. The electronic image may be an original image created electronically by any suitable computer application or device, or may be an original image which is scanned into an electronic format by any suitable scanning device and associated scanning software. In an embodiment, the electronic image is stored in computer memory by a graphics software program.

Referring also to FIGS. 5A and 6, at block 705 transparency 540 or 640 is created with transparency image 535 or 635 thereon converted from the electronic image. Transparency 540 or 640 is made of any suitable transparency medium and/or material known in the art which is capable of receiving an image thereon affixed and/or printed by a computer printer as known in the art. For example, transparency 540 or 640 may be transparency paper as known in the art.

The electronic image is printed and/or affixed onto a face of transparency 540 or 640 by any suitable means known in the art. In an embodiment, an electronic image which is stored in computer memory by a graphics software program is printed on a printer at the direction of the graphics software program. The computer upon which the graphics software program retains the electronic image in memory is in communication with a printer. The printer may be any suitable printer known in the art which is capable of receiving electronic images and printing such images onto a transparency. The graphics software program, through the computer and the communication means between the computer and the printer, directs the printer to print the electronic image. The printer prints the electronic image on the transparency by any suitable means known in the art, employing any suitable inks and/or pigments known in the art. Such inks may be translucent and/or opaque as known in the art for printing on transparencies.

When printing color and/or black and white images, the printer represents white in the resulting printout by an absence of any ink or other pigment. As such relates to transparency image 535 or 635, any white in the electronic image is represented by a clear area. It will be appreciated that depending upon the resolution of the electronic image, the electronic format of the electronic image (halftone, 256 colors, 64K colors, etc.), the resolution capabilities of the printer, and nature of the inks used therewith (translucent and/or opaque), certain areas of the transparency image 535 or 635 will be translucent or semi-translucent.

Transparency 540 or 640 is sized, as described herein with relation to FIGS. 5A and 6, for receipt in trough 545 and base 515 or slot 670 in frame 615. In an embodiment, transparency 540 or 640 is sized and shaped to generally duplicate the size and shape of white background-bearing medium 525 or 625. In an embodiment wherein white background-bearing medium 525 or 625 is sized smaller than a standard letter-sized (8.5×11 inch) letter, and wherein standard transparencies suitable for printing are a standard letter size, transparency 540 or 640 is cut down to white background-bearing medium 525 or 625 size after receiving the electronic image from the printer. It will be appreciated, as discussed below, that transparency image 535 or 635 is located on transparency 540 or 640 and sized so as to be viewable above the top face of base 515 or the bottom of slot 670. It will be appreciated that the size of the transparency may be any suitable size depending upon the amount and size of white background-bearing medium 525 or 625 which protrudes from base 515 or frame 615.

At block 710 an all-white image is created. The all-white image is created to equal the shape and dimensions of the transparency image 535 or 635. For example, if the transparency image is generally rectangular in shape and about 4 inches high and about 5 inches wide, the all-white image is created generally rectangular in shape and about 4 inches high and about 5 inches wide. Similarly, if the transparency image is generally circular with about a 5 inch diameter, the all-white image is created generally circular in shape with about a 5 inch diameter. Creation of the all-white image may be achieved by any suitable computer graphics software program known to one skilled in the art. The all-white image may be stored in any suitable format, including as a computer-readable file. In an embodiment, the all-white image is created with the same shape and size as the transparency image by a computer graphics software program and is stored in computer memory.

At block 715 the all-white image is optionally adjusted to accommodate screen printing as described below. Optional adjustments include any suitable graphical adjustments, including but not limited to adjustments to the frequency, angle, size and shape. The size and shape of the all-white channel may be adjusted to be larger in certain dimensions than the transparency image if a white border is desired around the resulting image. In an embodiment, the frequency, angle, size and shape of each of the channels is adjusted to accommodate screen printing onto glass or acrylic of a certain shape and size to reduce or eliminate moiré patterns. The adjustments may be accomplished by any suitable method known in the art, including by any suitable computer graphics software program. In an embodiment, the frequency, angle, size and shape of the all-white image is stored in computer memory by a computer graphics software program is adjusted by the computer graphics software program and the adjusted all white image is further stored in computer memory by the computer graphics software program.

At block 720 a film positive of the all-white image is created by any suitable method known in the art. In an embodiment, the all-white image is printed out by a computer printer at the direction of the computer graphics software program. Printing is either achieved directly onto film by a computer printer capable of printing onto film or onto an intervening media, such as paper, and then transferred to film by any suitable method known in the art.

At block 725 a silk screen is produced from the film positive. The silk screen may be produced from the film positive by any suitable method known in the silk screening arts. In an embodiment, it will be appreciated that a silk screen for the all-white image may be produced from an electronic form of the all-white image by use of a machine capable of producing a silk screen from an electronic image.

At block 730 the silk screen is silk screened onto the front or the back of white background-bearing medium. The silk screen is silk-screened with a mixture of clear-matt and white inks. The ink mixture is any suitable mixture of clear-matt and white inks. In an embodiment, the ink mixture is a textured ultra-violet, vinyl or similar ink suitable for printing on acrylic or glass and containing about 10% white additive (ink) and about 90% clear-matt finish (ink).

The silk screen is silk screened onto the white background-bearing medium so that, when transparency 540 or 640 is in front of white background-bearing medium 525 or 625, the silk screen is aligned behind the transparency image 535 or 635. If the silk screen has been sized larger than the transparency image to create a boarder, the silk screen is aligned so that transparency image 535 or 635 is generally centered within the silk screen. Any suitable form of alignment may be used to ensure that the silk screen is properly positioned in regard to the transparency image.

At block 735 the transparency 540 or 640 with transparency image 535 or 635 thereon is placed in base 515 or frame 615 in front of white background-bearing medium 525 or 625 with white silk-screen portion 530 or 630 thereon whereby transparency image 535 or 635 is in front of white silk-screen portion 530 or 630. As described herein, light propagating through white background-bearing medium 525 or 635 diffuses upon striking the ink of white silk-screen portion 530 or 630. Such diffused light will shine through clear portions of transparency image 535 or 635 which correspond to white portions the of original image, making such original white portions appear highlighted on the image of a display device of the present invention. Furthermore, to the extent colored areas of transparency image 535 or 635 comprise translucent or partially translucent ink, diffused light from white silk-screen portion 530 or 630 will partially shine through such translucent or partially translucent sections, making such sections appear brighter than opaque sections of the transparency image and non-silk-screened portions of white background-bearing medium 525 or 625. Such areas, however, will not appear as bright as clear areas, which maintains the impression to a viewer that such areas are highlighted.

While steps 710 through 730 have been described with respect to creation of white silk-screened portion 530 or 630 by silk screening, it will be appreciated by one skilled in the art that white silk-screened portion 530 or 630 may be created by any suitable method known in the art for applying and/or affixing a mixture of clear-matt and white inks as described herein to a white image-bearing medium as described herein. For example, a mixture of clear-matt and white inks may be applied as white silk-screened portion 530 or 630 by painting or lithography. In an embodiment, a mixture of clear-matt and white inks is painted and/or lithographed onto white background-bearing medium 525 or 625 so as to create an appropriated sized and shaped white silk-screened portion 530 or 630.

While the steps of this exemplary methodology have been described in a particular order, it will be appreciated that certain of the steps may be performed in any suitable order.

Figure 8:
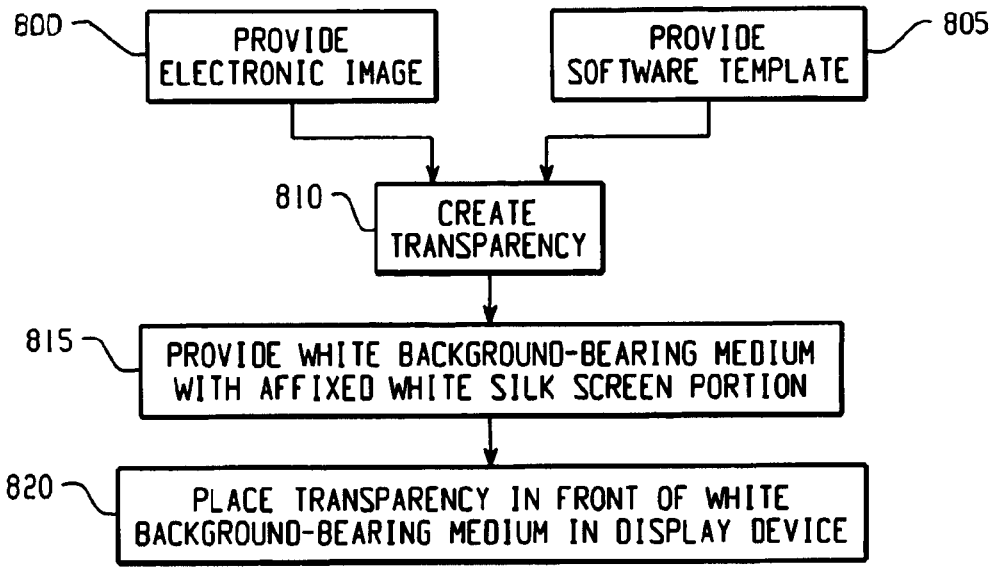
FIG. 8 is an exemplary methodology for providing an image for an illuminated display device in accordance with a further embodiment of the present invention.

Illustrated in FIG. 8 is another exemplary methodology for providing a transparency, a transparency image and a white silk-screened portion from an original image in accordance with one embodiment of the present invention.

At block 800 an electronic image is provided. The electronic image may have color and/or black and white. The electronic image may be an original image created electronically by any suitable computer application or device, or may be an original image which is scanned into an electronic format by any suitable scanning device and associated scanning software. In an embodiment, the electronic image is stored in computer memory by a graphics software program.

Figure 9:
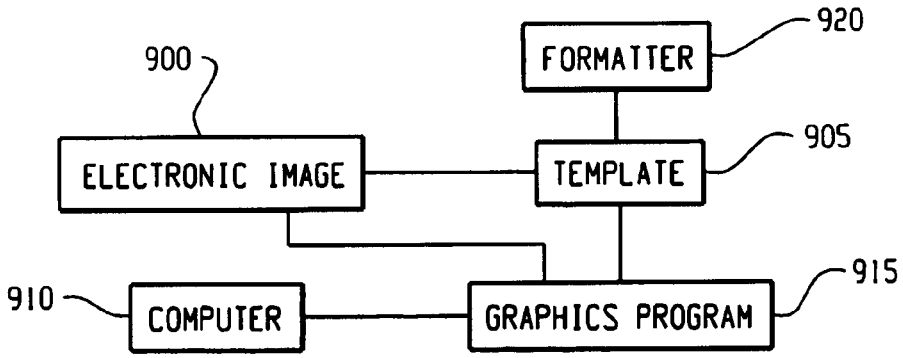
FIG. 9 is an exemplary system diagram of a computer implementation of a method of providing an image for an illuminated display device in accordance with one embodiment of the present invention.

At block 805 a software template for creating a transparency (a "template") is provided. Referring to FIG. 9, template 905 is a computer program which interacts with a computer graphics program 915 towards the purpose of electronically formatting electronic image 900. Template 905 uses formatter 920 for formatting the size and placement of an electronic image within the template. Graphics program 915 uses computer 910 to run template 905 towards this purpose.

Template 905 is a computer program which provides logic for adjusting, editing and/or formatting the electronic image for the purpose of suitable printing of the electronic image on a transparency. Template 905 may be any suitable computer program which provides such logic. In an embodiment, template 905 is an application template. An application template is a computer program which runs in conjunction with, and partially at the control of, another application or computer program. For example, a mail merge template may be provided for a word processing program (the application). The mail merge template is called by the word processor to perform a certain function. The mail merge template executes at such a call and performs such certain functions for the word processor. The mail merge template can not run separately from the word processor. Similarly, it is well known in the art to provide software templates for computer graphics programs. Such application templates perform certain functions for the computer graphics program upon call from the computer graphics program.

Figure 10:
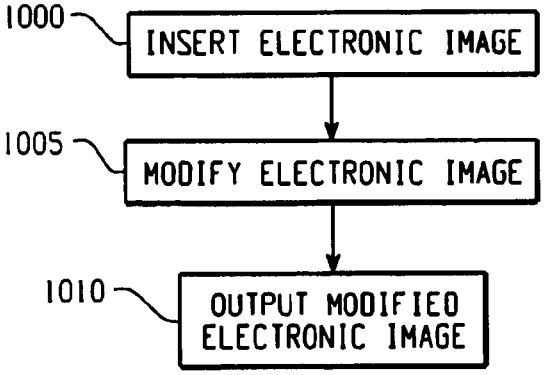
FIG. 10 is an exemplary methodology for modifying an image in accordance with one embodiment of the present invention.

Referring again to FIG. 8, at block 810 a transparency is created with the electronic image thereon. Referring additionally to FIG. 10, in an embodiment, transparency creation by template is described. Such a template is an application template for any suitable computer graphics program, including but not limited to Adobe Illustrator®. The computer graphics program is executed and a call is made to the template. At block 1000, the electronic image is inputted into the computer graphics program and inserted into the template. For example with Adobe Illustrator® version 8.0, the File/Place function is selected to locate the electronic image in storage and insert the electronic image into the template. The Object/Arrange/Send to Back function is selected to prepare the image within the template for further processing.

At block 1005, the electronic image in the template is resized according to size definitions contained within the template and the formatter. The template contains formatter which includes logic for determining an appropriate size for an image for a transparency of the present invention. As discussed below, the size of the resulting transparency image is determined by the size of the provided white silk-screen portion of the provided white background-bearing medium. In an embodiment, the template displays a pre-determined shape and size for a transparency image which corresponds to a pre-determined shape and size of a white silk-screen portion of a white background-bearing medium. Using formatter, the template facilitates adjustment, modification and/or editing of the electronic image so as to fit the electronic image into predetermined dimensions for the transparency. For example with Adobe Illustrator® version 8.0, the inputted electronic image is resized by dragging the boarder of the electronic image until the shape and size of the electronic image equals or fits into the predetermined dimensions of the template. The electronic image is dragged into a visual representation of such dimensions provided by the template. The modified electronic image is saved into computer memory by the template and the computer graphics program.

At block 1010, the modified electronic image is outputted by the template and computer graphics program. The modified electronic image may be outputted to any suitable printer which is capable of printing a transparency. A blank transparency is fed into the printer. The printer electronically receives the modified electronic image from the graphics computer program and the template. The printer prints the modified electronic image on the transparency. The resulting transparency image is located upon the transparency as defined by the template.

Referring again to FIGS. 8, 5A and 6, at block 815 white background-bearing medium 525 or 625 with an affixed white silk screen portion 530 or 630 is provided. White silk screen portion 530 or 630 comprises a mixture of clear-matt and white inks and is affixed to white background-bearing medium 525 or 625 by any suitable means described herein. White silk screen portion 530 or 630 is located upon white background-bearing medium 525 or 625 and sized so as to cover the area of transparency 540 or 640 which comprises transparency image 535 or 635. In an embodiment, white silk screen portion 530 or 630 is sized slightly larger than transparency image 535 or 635 to provide a highlighted boarder therearound. In an embodiment, both the template and the white background-bearing medium are shaped and sized so as to be visible over the top face of base 515 or the bottom of slot 670.

At block 820 the transparency is placed in front of the white background-bearing medium 525 or 625 and is retained in front of such by trough 545 and base 515 or slot 670 in frame 615.

While steps 810 through 830 have been described with respect to creation of white silk-screened portion 530 or 630 by silk screening, it will be appreciated by one skilled in the art that white silk-screened portion 530 or 630 may be created by any suitable method known in the art for applying and/or affixing a mixture of clear-matt and white inks as described herein to a white image-bearing medium as described herein. For example, a mixture of clear-matt and white inks may be applied as white silk-screened portion 530 or 630 by painting or lithography. In an embodiment, a mixture of clear-matt and white inks is painted and/or lithographed onto white background-bearing medium 525 or 625 so as to create an appropriated sized and shaped white silk-screened portion 530 or 630.

While the steps of this exemplary methodology have been described in a particular order, it will be appreciated that certain of the steps may be performed in any suitable order.

Figure 11:
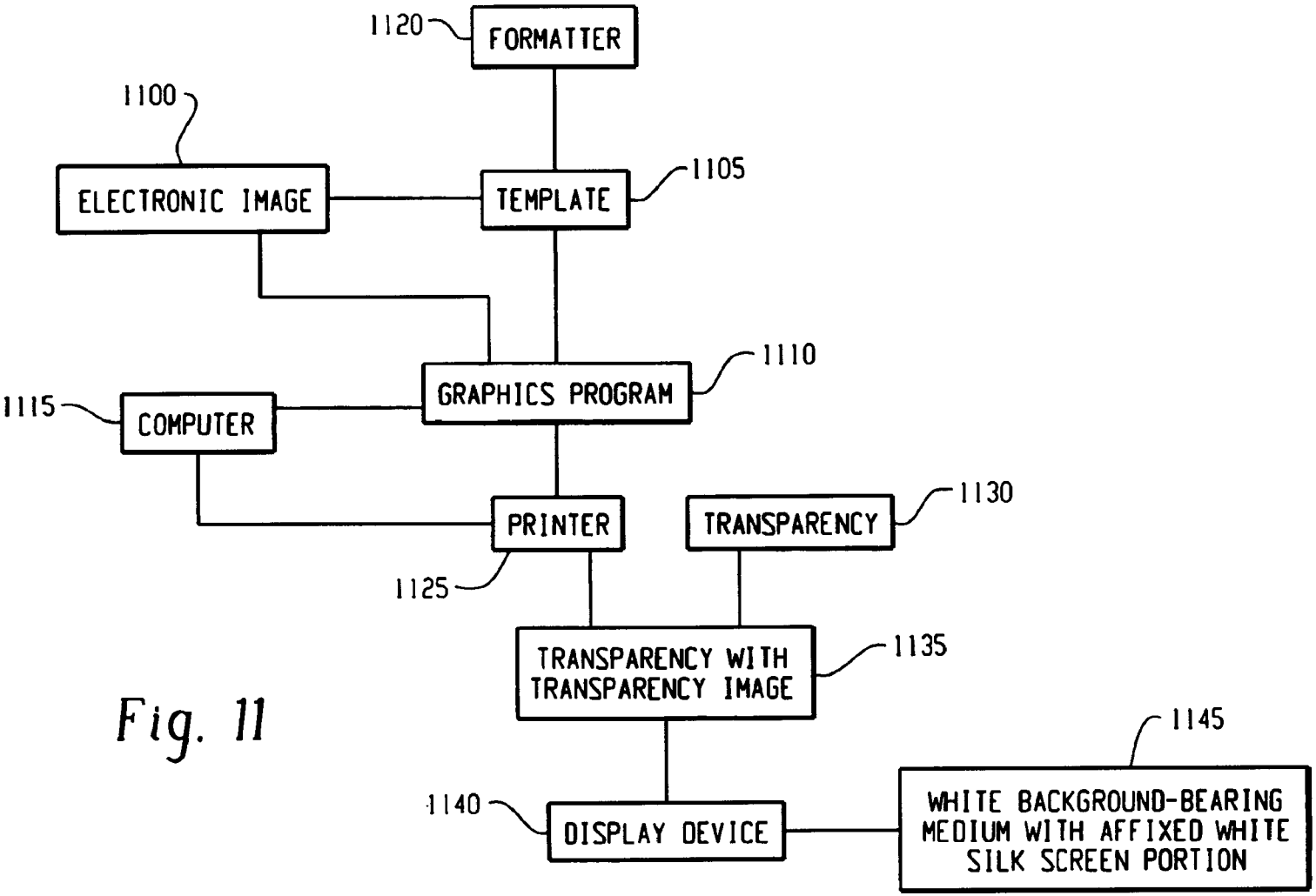
FIG. 11 is an overall system diagram of a system for providing an illuminated display device in accordance with one embodiment of the present invention.

Illustrated in FIG. 11 is an exemplary system for providing highlighted display of a transparency containing an image thereon in an illuminated display device of the present invention. Electronic image 1100 is provided by any means described herein and comprises an image with color and/or black and white. Using software template 1105 using formatter 1120, provided on a computer-readable medium, and computer 1115, computer graphics program 1110 modifies the electronic image into a suitable format for printing upon a transparency. Computer graphics program 1110 and computer 1115 transmit the modified electronic image to printer 1125 for printing. Using transparency 1130, printer 1125 prints the modified electronic image on the transparency, thus creating transparency with transparency image 1135. A white background-bearing medium with a white silk screen portion affixed thereto 1145 is provided, wherein the white silk screen portion is sized and located to be the same size and location as the transparency image on the transparency when the transparency and medium are biased within a display device. A display device 1140 of the present invention is provided for biasing the transparency and medium so as to allow illuminated and highlighted viewing of the transparency image.

While embodiments of this invention have been described in relation to creating one image for viewing upon a display device, it will be appreciated that a plurality of images may be provided for viewing upon a display device using embodiment of the invention as described herein.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative systems, and illustrative examples shown and described. Accordingly, departures may be made from such details without departing from the spirit or scope of the applicant's inventive concept.

I claim:

1. A method for providing an image for display by an illuminated display device having a generally clear image-bearing medium and a base containing an illumination source and positioning the image-bearing medium in proximity with the illumination source, whereby light from the illumination source is propagated through the image-bearing medium, comprising the steps of:

providing an electronic image;

converting the electronic image into a halftone black and white electronic image, wherein substantially achromatic colors of greatest lightness of the electronic image are represented by white in the halftone black and white electronic image, substantially achromatic colors of least lightness of the electronic image are represented by black in the halftone black and white electronic image, chromatic colors of the electronic image are represented by corresponding halftones in the halftone black and white electronic image;

inverting the halftone black and white electronic image to create an inverted halftone electronic image, wherein white of the halftone black and white electronic image is represented by black in the inverted halftone electronic image, black of the halftone black and white electronic image is represented by white in the inverted halftone electronic image, halftone of the halftone black and white electronic image is represented by a corresponding inverted halftone in the inverted halftone electronic image;

producing a film positive of the inverted halftone electronic image;

producing a silk screen from the film positive, wherein black of the film positive is represented by a pervious printing area of the silk screen, white of the film positive is represented by an impervious nonprinting area of the silk screen, halftone of the film positive is represented by a correspondingly partially pervious printing area of the silk screen; and silk-screening the silk screen onto the image-bearing medium by using a mixture of at least one clear-matt ink and at least one white ink.

2. The method of claim 1, wherein the electronic image is a color image and the step for converting the electronic image into a halftone black and white image further comprises the step of converting the electronic color image into a black and white image.

3. The method of claim 1, wherein the step of providing an electronic image comprises scanning a physical image into an electronically readable form.

4. The method of claim 1, wherein the step of converting the electronic image into a halftone black and white image comprises:

inputting the electronic image into a graphics software program; and using the graphics software program to convert the electronic image into the halftone black and white image.

5. The method of claim 1, wherein the step of inverting the halftone black and white image comprises:

inputting the halftone black and white image into a graphics software program; and using the graphics software program to invert the halftone black and white image into the inverted halftone image.

6. The method of claim 5, wherein the step of using the graphics software program to invert the halftone black and white image into the inverted halftone image further comprises:

using the graphics software program to adjust the size of the inverted halftone image to accommodate silk-screening onto the medium.

7. The method of claim 5, wherein the step of using the graphics software program to invert the halftone black and white image into the inverted halftone image further comprises:

using the graphics software program to adjust the frequency of the inverted halftone image to accommodate silk-screening onto the medium.

8. The method of claim 5, wherein the step of using the graphics software program to invert the halftone black and white image into the inverted halftone image further comprises:

using the graphics software program to adjust the angle of the inverted halftone image to accommodate silk-screening onto the medium.

9. The method of claim 5, wherein the step of using the graphics software program to invert the halftone black and white image into the inverted halftone image further comprises:

using the graphics software program to adjust the shape of the inverted halftone image to accommodate silk-screening onto the medium.

10. The method of claim 1 wherein the mixture of at least one clear-matt ink and at least one white ink is a textured ultra-violate ink mixture in the ratio of about 90% clear-matt finish and about 10% white additive.

11. The method of claim 1 wherein the mixture of at least one clear-matt ink and at least one white ink is a vinyl ink mixture in the ratio of about 90% clear-matt finish and about 10% white additive.

12. The method of claim 1 wherein the silk screen is silk-screened onto a front face of the clear image-bearing medium.

13. A method for providing an image for display by an illuminated display device having a light transmitting medium and an illumination source, comprising the steps of:

providing an electronic image stored in a computer graphics software program;

converting the electronic image into a halftone black and white electronic image by use of the computer graphics software program, wherein substantially achromatic colors of greatest lightness of the electronic image are represented by white in the halftone black and white electronic image, substantially achromatic colors of least lightness of the electronic image are represented by black in the halftone black and white electronic image, chromatic colors of the electronic image are represented by corresponding halftones in the halftone black and white electronic image;

inverting the halftone black and white electronic image by use of the computer graphics software program create an inverted halftone electronic image, wherein white of the halftone black and white electronic image is represented by black in the inverted halftone electronic image, black of the halftone black and white electronic image is represented by white in the inverted halftone electronic image, halftone of the halftone black and white electronic image is represented by a corresponding inverted halftone in the inverted halftone electronic image;

adjusting at least one graphical property of inverted halftone electronic image by use of the computer graphics software program, wherein the graphical property is selected from the group consisting of shape, size, frequency and angle;

producing a film positive of the inverted halftone electronic image;

producing a silk screen from the film positive, wherein black of the film positive is represented by a pervious printing area of the silk screen, white of the film positive is represented by an impervious nonprinting area of the silk screen, halftone of the film positive is represented by a correspondingly partially pervious printing area of the silk screen; and silk-screening the silk screen onto a surface of the light transmitting medium by using a mixture of at least one clear-matt ink and at least one white ink, whereby a representation of said inverted halftone electronic image is applied to said surface.

14. A method according to claim 13, further comprising the step of positioning the image-bearing medium in proximity with the illumination source, whereby light from the illumination source is propagated through the light transmitting medium and diffused by said image, thereby appearing as a highlight to a viewer.

* * * * *